US008646933B2

(12) United States Patent
Kim et al.

(10) Patent No.: US 8,646,933 B2
(45) Date of Patent: Feb. 11, 2014

(54) FLAT LIGHTING ASSEMBLY APPARATUS AND FLAT LIGHTING MODULE

(75) Inventors: Hwayoung Kim, Seoul (KR); Jin Wook Kim, Seoul (KR); Hyunha Shin, Seoul (KR); Sang Hoon Lee, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/617,872

(22) Filed: Sep. 14, 2012

(65) Prior Publication Data

US 2013/0010467 A1 Jan. 10, 2013

Related U.S. Application Data

(63) Continuation of application No. 13/116,072, filed on May 26, 2011, now Pat. No. 8,292,448.

(30) Foreign Application Priority Data

Sep. 24, 2010 (KR) ..... 10-2010-0092944
Sep. 24, 2010 (KR) ..... 10-2010-0092945
Sep. 24, 2010 (KR) ..... 10-2010-0092946
Sep. 24, 2010 (KR) ..... 10-2010-0092947

(51) Int. Cl.
*G09F 13/04* (2006.01)

(52) U.S. Cl.
USPC ..... 362/97.3; 362/97.1; 362/364; 362/367; 362/368

(58) Field of Classification Search
USPC ..... 362/97.3, 97.1, 364, 367, 368
See application file for complete search history.

(56) References Cited

U.S. PATENT DOCUMENTS

| | | | | |
|---|---|---|---|---|
| 7,481,569 | B2 | 1/2009 | Chang | |
| 7,658,504 | B2 | 2/2010 | Moriyasu et al. | |
| 7,661,834 | B2 * | 2/2010 | Fenyo | 362/19 |
| 8,025,422 | B1 * | 9/2011 | Huang et al. | 362/241 |
| 2007/0053176 | A1 * | 3/2007 | Chou | 362/97 |

FOREIGN PATENT DOCUMENTS

| | | |
|---|---|---|
| JP | 2001-202817 | 7/2001 |
| JP | 2007-335371 | 12/2007 |
| JP | 2009-016052 | 1/2009 |
| JP | 2010-129212 | 6/2010 |
| JP | 2010-198859 | 9/2010 |
| KR | 1020090093493 | 9/2009 |

OTHER PUBLICATIONS

Chinese Office Action mailed on Aug. 5, 2013.

* cited by examiner

*Primary Examiner* — Evan Dzierzynski
(74) *Attorney, Agent, or Firm* — Lowe Hauptman & Ham, LLP

(57) ABSTRACT

The flat lighting assembly apparatus comprises: a ceiling member; a power supply controller disposed within the ceiling member; a connector coupled to the ceiling member and electrically connected to the power supply; and a flat lighting module coupled to the connector and comprising; a frame including a base, an extension portion extending from the base, a socket disposed on a rear surface of the base, and a guide disposed on the rear surface of the base and disposed around the socket; a light source disposed on a front surface of the base; and a diffusion plate disposed on the light source and coupled to the base, wherein the connector has a insertion groove electrically connected to the socket and comprises a coupling unit coupled to the guide.

20 Claims, 4 Drawing Sheets

FLAT LIGHTING ASSEMBLY APPARATUS AND FLAT LIGHTING MODULE

CROSS-REFERENCE TO RELATED APPLICATION

This application is a Continuation Application of U.S. application Ser. No. 13/116,072 filed May 26, 2011, which claims priority from Korean Applications Nos. 10-2010-0092944, 10-2010-0092945, 10-2010-0092946 and 10-2010-0092947, all filed on Sep. 24, 2010, the subject matters of which are incorporated herein by reference.

TECHNICAL FIELD

The present disclosure relates to a flat lighting assembly apparatus and a flat lighting module.

BACKGROUND

In general, an electric bulb or a fluorescent lamp is commonly used as an indoor or outdoor lighting lamp. However, the electric bulb or the fluorescent lamp has a short life span, so that it should be frequently changed. Moreover, a conventional fluorescent lamp degrades due to the time it is used. As a result, often its illuminance is gradually decreased.

In order to overcome such problems, a lighting apparatus is now being developed by using a light emitting device (hereinafter, referred to as LED). The LED is easy to control and has a rapid response speed, high electro-optic conversion efficiency, a long life span, low power consumption and high luminance. The LED is also used to create emotional lighting.

Meanwhile, the shapes of most of lighting apparatus to which the LED is applied are limited in accordance with the structure of the space in which the lighting apparatus is installed. Therefore, the field of use of the lighting apparatus or a kind of a space in which the lighting apparatus is used is increasing.

SUMMARY

One embodiment is a flat lighting assembly apparatus. The flat lighting assembly apparatus comprises: a ceiling member; a power supply controller disposed within the ceiling member; a connector coupled to the ceiling member and electrically connected to the power supply; and a flat lighting module coupled to the connector and comprising; a frame including a base, an extension portion extending from the base, a socket disposed on a rear surface of the base, and a guide disposed on the rear surface of the base and disposed around the socket; a light source disposed on a front surface of the base; and a diffusion plate disposed on the light source and coupled to the base, wherein the connector has a insertion groove electrically connected to the socket and comprises a coupling unit coupled to the guide.

Another embodiment is a flat lighting module. The flat lighting module comprises: a frame including a base, an extension portion extending from the base, a socket disposed on a outer surface of the base, and a guide disposed on the outer surface of the base and disposed around the socket; a light source disposed on a inner surface of the base; a diffusion plate disposed on the light source and coupled to the base, and a connector having a insertion groove electrically connected to the socket of the frame and comprising a coupling unit coupled to the guide of the frame, wherein the socket of the frame comprises a first electrode to which positive voltage is supplied and a second electrode to which negative voltage is supplied.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
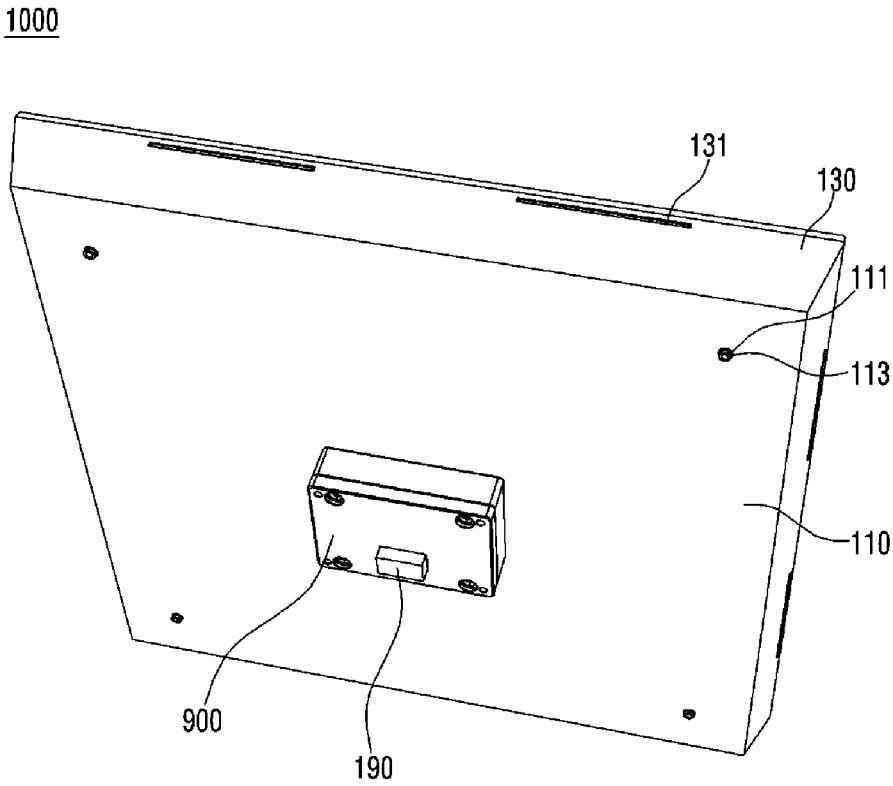
FIG. 1 is a perspective view of a flat lighting module according to an embodiment of the present disclosure.
Figure 2:
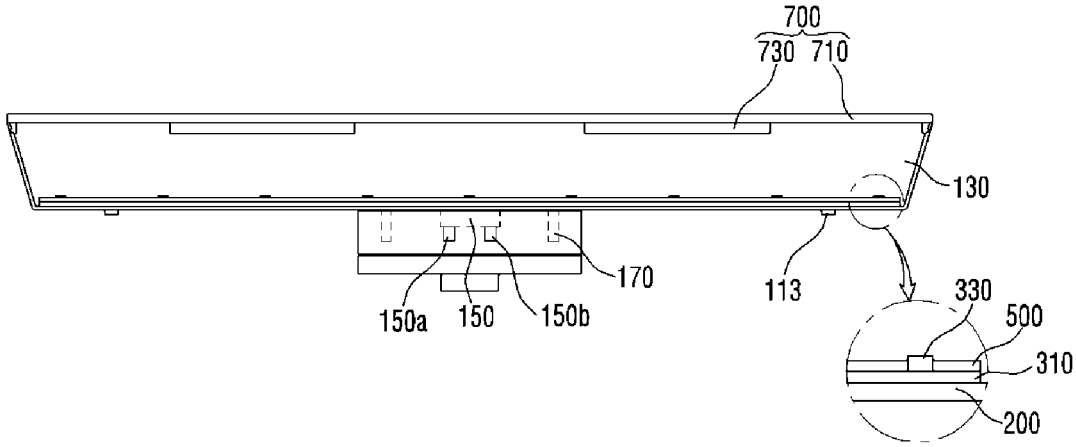
FIG. 2 is a cross sectional view of the flat lighting module according to the embodiment of the present disclosure.
Figure 3:
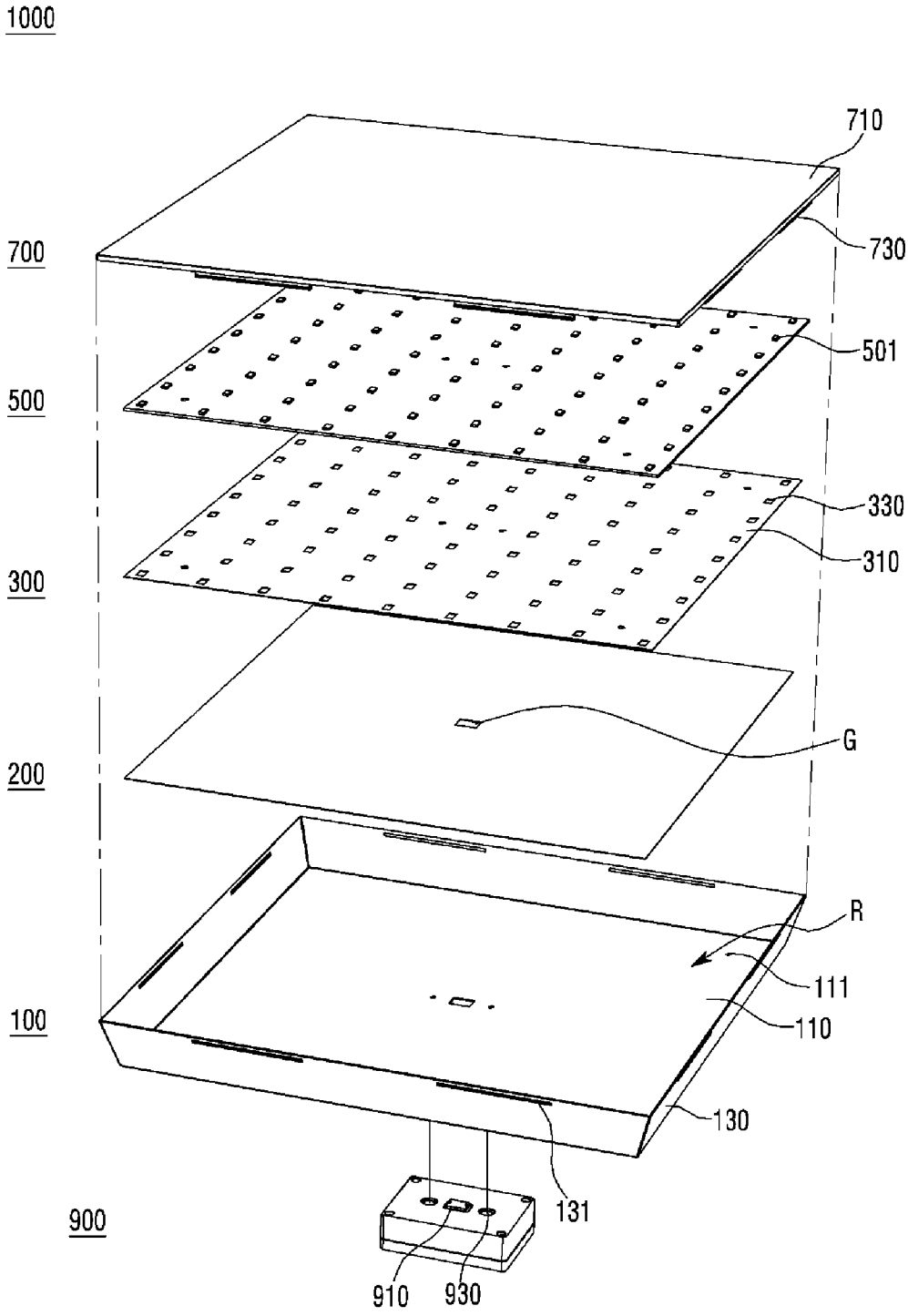
FIG. 3 is an exploded perspective view for describing a structure of the flat lighting module according to the embodiment of the present disclosure.

FIG. 1 is a perspective view of a flat lighting module according to an embodiment of the present disclosure. FIG. 2 is a cross sectional view of the flat lighting module according to the embodiment of the present disclosure. FIG. 3 is an exploded perspective view for describing a structure of the flat lighting module according to the embodiment of the present disclosure.

Referring to FIGS. 1 to 3, a flat lighting module 1000 includes a frame 100, a heat radiation sheet 200, a light source unit 300, a reflection plate 500, a diffusion plate 700 and a connector 900.

The frame 100 is formed by assembling a plurality of flanges or may be extrusion molded in the form of one member. The material of the frame 100 includes not only a plastic material such as polyvinyl chloride (PVC), but a conductive material such as metal which is capable of satisfactorily transferring heat generated from a light source unit to the outside. The frame 100 includes a base 110 and an extension portion 130.

The base 110 has a quadrangle plate shape of which corners have holes 111. The base 110 is screw-fastened 113 and coupled to the light source unit 300 through the holes 111. The center portion of the rear side of the base 110 is mechanically connected to a socket 150 for supplying electric power to the light source unit. One or more guides 170 are formed projecting around the socket 150 of center portion of the rear side of the base 110. The guide 170 has the same material as that of the base 110 and allows the socket 150 to be easily electrically connected to the connector 900.

The extension portion 130 extends from the four edges of the base 110 at a predetermined angle with respect to the surface of the base 110. Here, the predetermined angle is an obtuse angle. Therefore, the frame 100 includes a seat R formed by the base 110 and the extension portion 130. The extension portion 130 forms an obtuse angle with the surface of the base 110 in order to maximize luminous efficiency according to the orientation angle of light generated from the light source unit disposed in the seat. That is, the light generated from the light source unit is emitted having a predetermined orientation angle equal to or greater than 90° in order that the light is at least prevented from being blocked by the extension portion.

When the light emitted from the light source unit 300 is irradiated to the extension portion 130, the light is reflected to the diffusion plate 700 by coating a reflective material on the inner surface of the extension portion 130. Besides, at least one rectangular locking hole 131 is formed around the edge portions of the extension portion 130. A locking projection 730 to be described below of the diffusion plate 700 is inserted into and coupled to the locking hole.

The light source unit 300 includes a substrate 310 and a plurality of light emitting devices 330 mounted on the substrate 310.

The substrate 310 may have no limit in its shape so that it may have a structure corresponding to the shape of the base 110 of the frame 100. The substrate 310 is formed by printing a circuit pattern on an insulator. For example, in embodiments the substrate 310 includes not only a printed circuit board (PCB), a metal core PCB, a flexible PCB, a ceramic PCB and the like but also a chips on board (COB) allowing an unpackaged LED chip to be directly bonded thereon. The substrate 310 is made of a material efficiently reflecting light. Otherwise, the surface of the substrate 310 may have a color by which light is efficiently reflected, for example, white and silver, etc.

The plurality of the light emitting devices 330 are arranged on the substrate in a strip pattern. Each of the plurality of the light emitting devices 330 can include at least one light emitting diode (LED). The LED may correspond to a red LED, green LED, blue LED or white LED, each of which emits red, green, blue or white light respectively. There is no limit to the kind and the number of the LEDs.

Meanwhile, a heat radiation sheet 200 is disposed between the light source unit 300 and the base 110 of the frame 110. The heat radiation sheet 200 includes a thermal conductive material, so that heat generated from the light source unit 300 is transferred to the frame 300 and radiated to the outside. In consideration of an electrical connection path between the light source unit 300 and the connector 900, the heat radiation sheet 200 also includes an opening G which is formed in an area corresponding to an area in which a connector is disposed.

The reflection plate 500 includes a plurality of holes 501 of which the number is the same as that of the plurality of the light emitting devices 330 disposed on the substrate 310. The reflection plate 500 is placed on the light source unit 300 such that the plurality of the light emitting devices are disposed in the plurality of the holes 501 respectively so that light from the light emitting devices are exposed. In other words, the reflection plate 500 is disposed on the light source unit 300 such that the plurality of the light emitting devices 330 are exposed outward through the plurality of the holes 501. When light emitted from the light source unit 300 is emitted to the outside through the diffusion plate 700, the reflection plate 500 re-reflects the light reflected by the diffusion plate 700 and transmits the light to the outside.

The reflection plate 500 can be made of a metallic material or a resin material which has a high reflection efficiency. For example, the resin material includes any one of polyethylene terephthalate (PET), polycarbonate (PC), or PVC resin. The metallic material includes at least one of Ag, an alloy including Ag, Al or an alloy including Al.

The surface of the reflection plate 500 is coated with Ag, Al, white photo solder resist (PSR) ink and a diffusion sheet and the like. Otherwise, an oxide layer is formed on the surface of the reflection plate 500 by an anodizing process. However, there is no limit to the material and color of the reflection plate 500. The material and color of the reflection plate 500 can be variously selected according to the illumination implemented by the flat lighting module 1000.

The diffusion plate 700 diffuses the light emitted from the light source unit 300 and emits the light to the outside. The diffusion plate 700 includes a base plate 710 having the same shape as that of the light source unit 300 or the reflection plate 500. Besides, at least one locking projection 730 is disposed on the edge of the base plate 710. Such a diffusion plate 700 is disposed over the reflection plate 500, and the locking projection 730 of the diffusion plate inserted into the locking hole 131 of the frame, so that the diffusion plate 700 is mechanically coupled to the frame 100. Meanwhile, the locking projection 730 of the diffusion plate is inserted and coupled to the locking hole 131 of the extension portion 130 of the frame in a direction from the inside to the outside of the extension portion. This intends to obtain structural stability.

The diffusion plate 700 is spaced apart from and over the light source unit 300. Here, the diffusion plate is disposed in a position that prevents a light spot of the light emitted from the light emitting device of the light source unit 300 from being generated in the base plate 710 of the diffusion plate. That is to say, although the diffusion plate 700 may be disposed as close as possible to the light source unit, the diffusion plate 700 is disposed at a position that prevents a light spot from being generated. Further, the diffusion plate 700 is thick enough to prevent darkness from being generated on the edge thereof. The diffusion plate 700 may be at least thicker than the substrate 310 of the light source unit.

Meanwhile, a diffusing lens (not shown) may be disposed on the diffusion plate 700 so as not to generate darkness on the edge of the diffusion plate.

The diffusion plate 700 is made of a plastic material such as polypropylene (PP) and polyethylene (PE), etc. unlike that of the frame in order to obtain fixability and stability after the lighting module is installed. Among the plastic materials, polycarbonate (PC) having high light resistance, high thermal resistance and excellent impact strength property can be used as the material of the diffusion plate 700.

The connector 900 is electrically connected to the socket 150 in order to supply electric power to the light source unit 300 through the socket 150. The connector 900 includes a first insertion groove 910 and a second insertion groove 930. The connector 900 is electrically connected to the socket 150 by inserting the socket 150 into the first insertion groove 910 formed on one side of the connector 900. The connector 900 is mechanically coupled to the frame 100 by inserting the guide 170 projecting at the center portion of the rear side of the base 110 of the frame 100 into the second insertion groove 930. Besides, the other side of the connector 900 includes a protruding member 190 that is mechanically connected to a ceiling or the surface of a wall.

Figure 4:
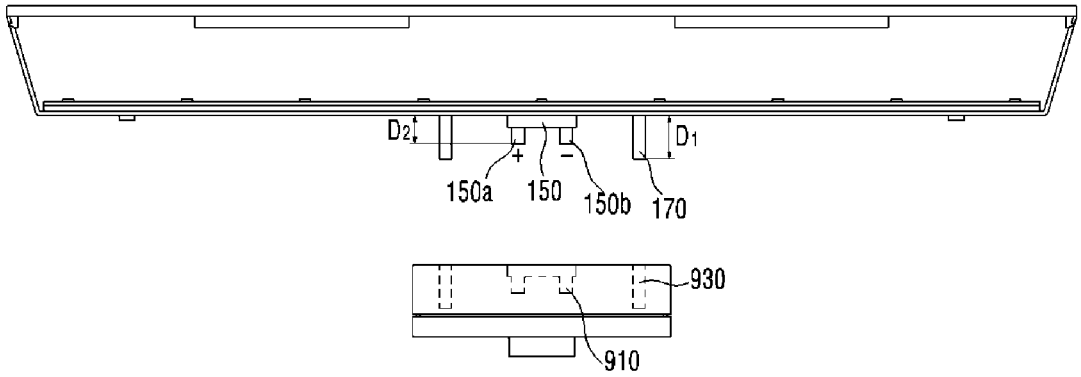
FIG. 4 is shows embodiment of the present disclosure and how a socket of the flat lighting module is connected to a connector of the flat lighting module.

FIG. 4 shows an embodiment of the present disclosure and how the socket of the flat lighting module is connected to the connector of the flat lighting module.

As shown, the socket 150 disposed on the rear side of the frame 100 includes a first electrode 150*a* to which positive voltage is supplied and a second electrode 150*b* to which negative voltage is supplied. The socket 150 is inserted into the first insertion groove 910 of the connector, so that the socket is electrically connected to the connector. Here, the electrical connection is established by using a push-pull method.

Meanwhile, the plurality of the guides 170 are formed around the socket 150 on the rear side of the frame. The guides 170 may have mutually different shapes from each other. The guides 170 have cylindrical shapes having mutually different diameters from each other. This makes it easier to cause the socket 150 and the connector 900 to be electrically connected to each other with correct polarities. That is, when the plurality of the guides 170 have mutually different shapes from each other, it is easy to distinguish the position of the first electrode 150*a* from that of the second electrode 150*b*, so that the socket 150 is connected in a stable manner to the connector 900 without an electrical short-circuit.

Further, a distance D1 from one end to the other end of the guide 170 is greater than a distance D2 from one end to the other end of the socket 150. This is because first of all the guide 170 should be correctly inserted into the second insertion groove 930 of the connector in order to accurately align the socket 150 with the guide 170 when the socket 150 and the guide 170 are connected to the first insertion groove 910 and the second insertion groove 930 respectively. Therefore, mechanically, the entire length of the guide 170 needs to be greater than that of the socket 150. If not, the socket 150 and the connector 900 may be electrically connected to each other with incorrect polarities, so that the electrical short-circuit may occur.

Figure 5:
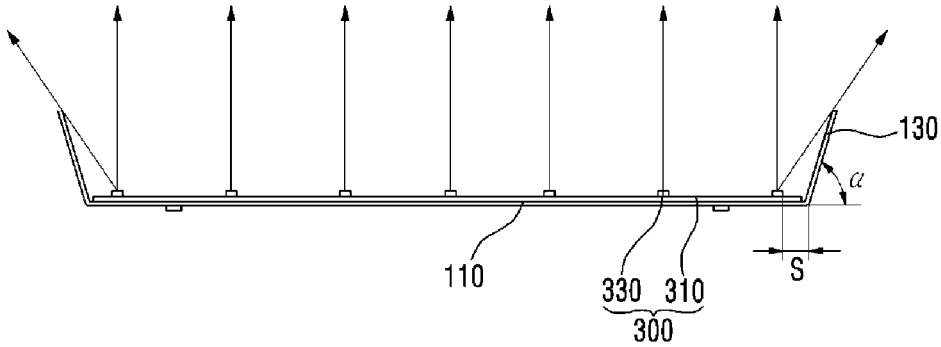
FIG. 5 is an embodiment of the present disclosure and is a view for describing an arrangement structure of the light source unit.

FIG. 5 is an embodiment of the present disclosure and is a view for describing an arrangement structure of the light source unit.

As shown, the light source unit 300 is disposed on the base 110 of the frame 100. Here, the light emitting devices that are the closest to the extension portion 130 of the frame 100 among the plurality of the light emitting devices 330 of the light source unit 300 are disposed separately from the extension portion 130 at a predetermined interval S. The predetermined interval S is at least 5 mm. The aforementioned numerical range is intended to obtain at least work efficiency when the light source unit 300 is disposed on the extension portion 130 of the frame 100.

The light emitting devices are disposed separately from the extension portion 130 at the predetermined interval so that light with the maximum orientation angle among all light emitted from the light emitting devices 330 is at least not reflected by the extension portion. Thus, the luminous efficiency of the flat lighting module can be hereby improved. When the light emitted from the light emitting devices 330 is directly irradiated to the extension portion, darkness may occur around the edge of the diffusion plate.

The surface of the extension portion 130 is inclined at an acute angle ($\alpha$) with respect to the extension line of the surface of the base 110. This intends to maximally reduce the darkness occurring around the edge of the diffusion plate, when the flat lighting module is operated. Here, it is desirable that the acute angle is between 65° and 75°. This is because it is possible to reduce the darkness and to assemble a plurality of the flat lighting modules in a mechanically stable manner.

Such a flat lighting module itself can be used as a lighting apparatus.

Figure 6:
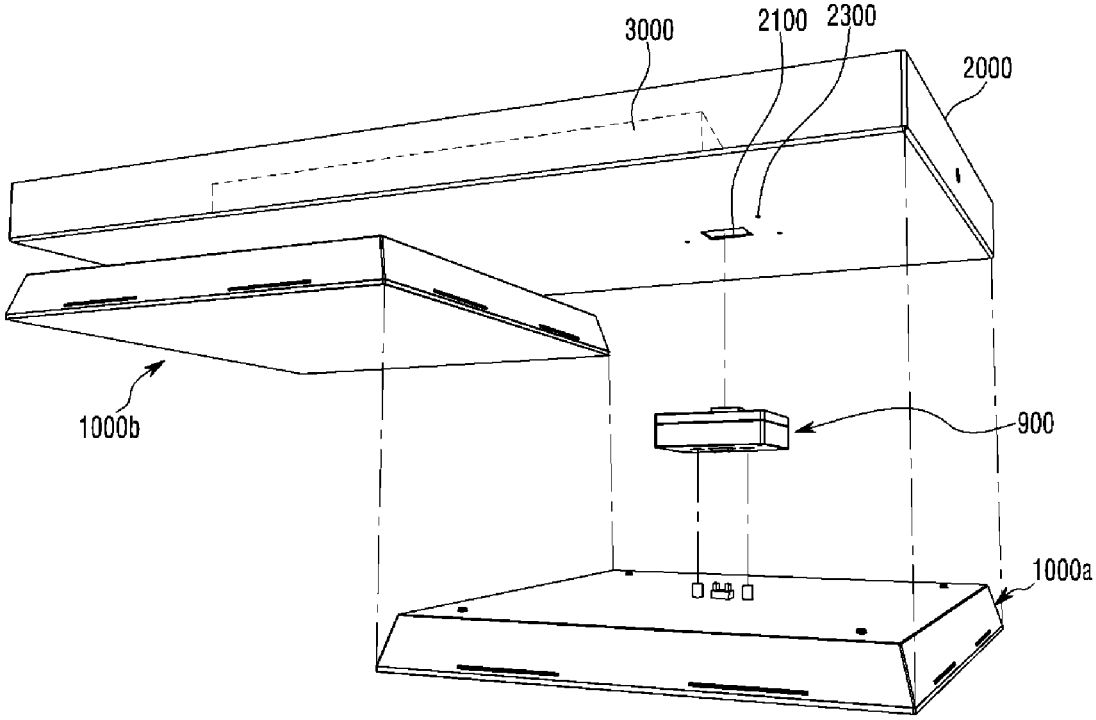
FIG. 6 is an embodiment of the present disclosure and is an exploded perspective view of a flat lighting assembly apparatus including a plurality of flat lighting modules.
Figure 7:
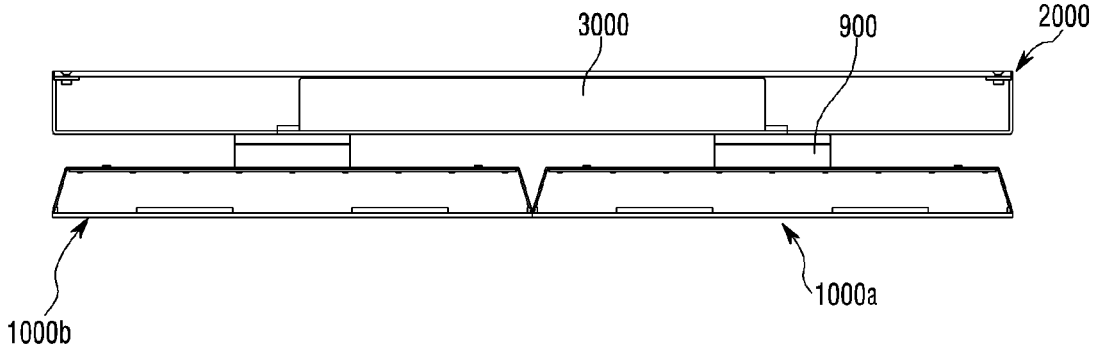
FIG. 7 is an embodiment of the present disclosure and is a cross sectional view of the flat lighting assembly apparatus including the plurality of flat lighting modules.

FIG. 6 is an embodiment of the present disclosure and is an exploded perspective view of a flat lighting assembly apparatus including a plurality of the flat lighting modules. FIG. 7 is an embodiment of the present disclosure and is a cross sectional view of the flat lighting assembly apparatus including the plurality of the flat lighting modules.

Referring to FIGS. 6 and 7, a flat lighting assembly apparatus includes a first flat lighting module 1000*a*, a second flat lighting module 1000*b*, a ceiling member 2000, and a power supply controller 3000.

Since the first flat lighting module 1000*a* and the second flat lighting module 1000*b* have been described in FIGS. 1 to 3, descriptions thereof will be omitted. Here, the first flat lighting module 1000*a* and the second flat lighting module 1000*b* may be disposed at a regular interval. Heat generated at the time of operating the flat lighting modules is effectively radiated through the separation interval.

The ceiling member 2000 is a quadrangular shaped case and includes a groove 2100 allowing the ceiling member 2000 to be mechanically coupled to the protruding member of the connector. For the purpose of mechanically stable coupling of the ceiling member 2000, the ceiling member 2000 also includes a plurality of holes 2300 which are formed around the groove 2100 thereof and are used to fasten a screw (not shown) to the connector 900.

As such, in a mechanical coupling between the ceiling member 2000 and the connector 900 of the flat lighting module, the flat lighting module is attachable to and removable from the ceiling member 2000 if necessary, so that it is possible to increase spatial utilization in the disposition of the lighting apparatus.

The power supply controller 3000 controls the power supply of each of the flat lighting modules and is disposed within the ceiling member 2000. The disposition area of the power supply controller 3000 can be changed in consideration of mechanical stability, heat radiating characteristics, and the like.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A flat lighting assembly apparatus comprising:

a ceiling member;

a power supply controller disposed within the ceiling member;

a connector coupled to the ceiling member and electrically connected to the power supply controller; and a flat lighting module coupled to the connector and comprising;

a frame including a base, an extension portion extending from the base, a socket disposed on a rear surface of the base, and a guide disposed on the rear surface of the base and disposed around the socket;

a light source disposed on a front surface of the base; and a diffusion plate disposed on the light source and coupled to the base, wherein the connector has a insertion groove electrically connected to the socket and comprises a coupling unit coupled to the guide.

2. The flat lighting assembly apparatus of claim 1, wherein the light source closest to the extension portion emits light toward the diffusion plate directly.

3. The flat lighting assembly apparatus of claim 1, wherein the lighting source comprises a plurality of light emitting devices, and wherein a light emitting device that is the closest to the extension portion among the plurality of the light emitting devices is disposed separately from the extension portion at a predetermined interval.

4. The flat lighting assembly apparatus of claim 3, wherein the predetermined interval is at least 5 mm.

5. The flat lighting assembly apparatus of claim 3, wherein the flat lighting module further comprises a reflection plate having a plurality of holes and being disposed on the light source such that the plurality of the light emitting devices are disposed in the plurality of the holes respectively so that light from the light emitting devices is exposed.

6. The flat lighting assembly apparatus of claim 3, wherein the diffusion plate is spaced apart from and over the light source such that a light spot of the light emitted from the light emitting devices is not generated at least in the diffusion plate.

7. The flat lighting assembly apparatus of claim 1, wherein a surface of the extension portion is inclined at an acute angle with respect to a line extended from the rear surface of the base.

8. The flat lighting assembly apparatus of claim 7, wherein the acute angle is between 65° and 75°.

9. The flat lighting assembly apparatus of claim 1, wherein the frame comprises a reflective material coated on an inner surface of the extension portion.

10. The flat lighting assembly apparatus of claim 1, wherein the extension portion of the frame comprises at least one locking hole, wherein the diffusion plate comprises at least one locking projection disposed on the edge thereof, and wherein the locking projection of the diffusion plate is coupled to the locking hole of the extension portion of the frame.

11. The flat lighting assembly apparatus of claim 10, wherein the locking projection of the diffusion plate is inserted and coupled to the locking hole of the extension portion of the frame in a direction from the inside to the outside of the extension portion.

12. The flat lighting assembly apparatus of claim 1, wherein the flat lighting module further comprises a heat radiation sheet disposed between the light source and the base of the frame.

13. The flat lighting assembly apparatus of claim 1, wherein the socket of the frame is disposed around the center portion of the base, and wherein the socket and the connector are connected with each other by using a push-pull method.

14. The flat lighting assembly apparatus of claim 1, wherein a plurality of the guides are provided and the guides have mutually different shapes from each other.

15. The flat lighting assembly apparatus of claim 1, wherein a plurality of the guides are provided and the guides have cylindrical shapes having mutually different diameters from each other.

16. The flat lighting assembly apparatus of claim 1, wherein a distance from a first end to a second end of the guide is greater than a distance from a first end to a second end of the socket measured perpendicularly to the base.

17. The flat lighting assembly apparatus of claim 1, wherein the light source comprises a substrate disposed on the front surface of the base, wherein the diffusion plate is at least thicker than the substrate.

18. The flat lighting assembly apparatus of claim 1, wherein the connector further comprises a protruding member, wherein the ceiling member has a groove coupled to the protruding member.

19. A flat lighting assembly apparatus, comprising:

a ceiling member;

a power supply controller disposed within the ceiling member;

a connector coupled to the ceiling member and electrically connected to the power supply controller; and a flat lighting module coupled to the connector and comprising:

a frame including a base, an extension portion extending from the base, a socket disposed on a outer surface of the base, and a guide disposed on the outer surface of the base and disposed around the socket;

a light source disposed on a inner surface of the base; and a diffusion plate disposed on the light source and coupled to the base, wherein the connector has a insertion groove electrically connected to the socket of the frame and comprising a coupling unit coupled to the guide of the frame, and wherein the socket of the frame comprises a first electrode to which positive voltage is supplied and a second electrode to which negative voltage is supplied.

20. The flat lighting assembly apparatus of claim 19, wherein a distance from one end to the other end of the guide is greater than a distance from one end to the other end of at least of the first electrode and/or the second electrode.

* * * * *